United States Patent [19]

Holt

[11] 3,931,551

[45] Jan. 6, 1976

[54] CONTROL CIRCUITS FOR DOUBLE ACTING ELECTROMAGNETS

[75] Inventor: William David Holt, Colne, England

[73] Assignee: The Lucas Electrical Company Limited, Birmingham, England

[22] Filed: Mar. 28, 1974

[21] Appl. No.: 455,622

[30] Foreign Application Priority Data

May 16, 1973 United Kingdom ..... 23268/73

[52] U.S. Cl. ..... 317/151; 317/154

[51] Int. Cl.[2] ..... H01H 47/00

[58] Field of Search ..... 317/151, 154, 139, 140

[56] References Cited

UNITED STATES PATENTS

| | | | |
|---|---|---|---|
| 2,317,888 | 4/1943 | Cypser | 317/151 |
| 2,389,564 | 11/1945 | Sunstein | 317/151 |
| 2,635,197 | 4/1953 | Routledge et al. | 317/151 |
| 3,159,773 | 12/1964 | Elliott | 317/151 |
| 3,174,080 | 3/1965 | Scott | 317/151 |
| 3,365,625 | 1/1968 | Pearse | 317/151 |

FOREIGN PATENTS OR APPLICATIONS

| | | | |
|---|---|---|---|
| 1,911,780 | 10/1969 | Germany | 317/151 |

*Primary Examiner*—J. D. Miller
*Assistant Examiner*—Harry E. Moose, Jr.
*Attorney, Agent, or Firm*—Gaylord P. Haas, Jr.

[57] ABSTRACT

A control circuit for a double acting electromagnet has two capacitors connecting opposite ends of the electromagnet to one supply line. The ends of the electromagnet can also be connected to the other supply line by way of a two position contact and a normally open switch. The capacitors control energisation of the electromagnet.

6 Claims, 1 Drawing Figure

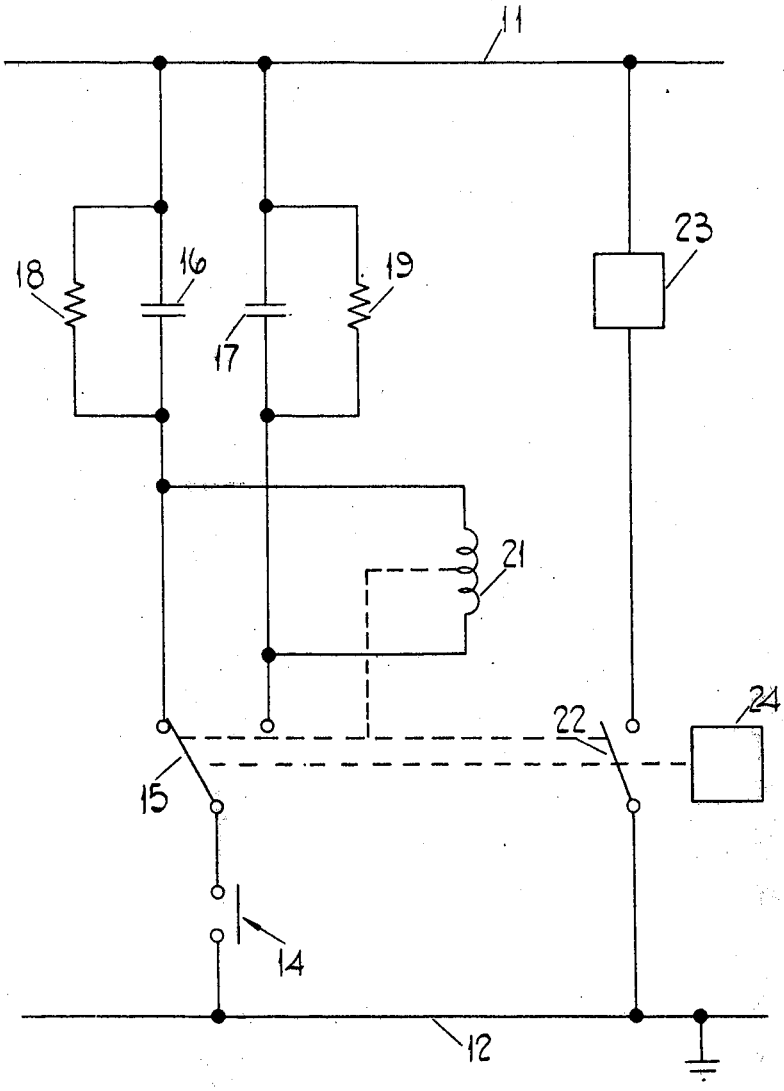
11
18
16
17
19
23
21
22
24
15
14
12

CONTROL CIRCUITS FOR DOUBLE ACTING ELECTROMAGNETS

This invention relates to control circuits for double acting electromagnets.

A control circuit according to the invention comprises in combination first and second terminals for connection to a d.c. source, a pair of capacitors connecting opposite ends respectively of the electromagnet to the first terminal, discharge paths for the capacitors, a two position contact operable by the electromagnet, and a normally open switch, said contact serving in its two positions respectively to connect opposite ends of the electromagnet by way of the switch to the second terminal.

The accompanying drawing is a circuit diagram illustrating one example of the invention.

Referring to the drawing, there are provided positive and negative supply lines 11, 12, the line 12 conveniently being earthed. There is further provided a push button switch 14 which is spring loaded to its open position, and serves to connect the line 12 to a two-position movable contact 15 which in the position shown completes a circuit to the line 11 by way of a capacitor 16, and in its alternative position completes a circuit to the line 11 by way of a capacitor 17. The capacitors 16, 17 are bridged by resistors 18, 19 respectively, and the fixed contact engageable by the contact 15 are bridged by an electromagnet 21. When energised, the electromagnet 21 moves the contact 15 from one position to its alternative position, and also controls a contact 22 connected in series with a load 23 between the lines 12, 11. The contacts 22 and 15 have associated therewith a permanent magnet 24 which when the contact 22 is moved to its closed position, and the contact 15 is moved to its alternative position, holds the contacts 22 and 15 in their closed and alternative positions respectively until the contacts are moved back to the positions shown by the electromagnet 21.

Assuming that the contact 15 is in the position shown, then closing of the switch 14 will cause the capacitor 16 to charge instantaneously, and the capacitor 17 to charge more slowly by way of the winding 21. As a result, the winding 21 is energised for a sufficient time to move the contacts 15 and 22 to their alternative and closed positions respectively. By the time the contact 15 is in its alternative position, both the contacts 15 and 22 will be under the control of the permanent magnet 24. Assuming that the switch 14 is now allowed to open, then the contacts 15 and 22 remain in their alternative and closed positions respectively, and the capacitors 16 and 17 discharge by way of their resistors 18 and 19 respectively. If the switch 14 is now closed again, the capacitor 17 charges instantaneously, and the capacitor 16 charges more slowly by way of the winding 21. The current flow through the winding 21 is in the opposite direction from previously, and so the winding 21 now moves the contacts 15 and 22 against the action of the magnet 24 to the position shown.

If the switch 14 is held closed for too long, the capacitors 16 and 17 in conjunction with the contact 15 ensure that the circuit does not operate for a second time. Thus, consider the situation when the contacts 15 and 22 have moved respectively to their alternative and closed positions. In this situation, the capacitor 16 is almost fully charged. Because the capacitor 16 is almost fully charged, current does not flow through the winding 21 to charge the capacitor 16, and so the circuit does not operate again. The capacitors 16 and 17 will not of course discharge until the contact 14 is opened. Similar considerations apply when the contacts 15 and 22 have just been moved to the position shown.

It will be appreciated that with an arrangement of the form described, when the contact 15 moves from the position shown to its alternative position, then at the instant when the contact 15 moves out of connection with its fixed contact, its momentum is such that it will continue to move into engagement with the other fixed contact, assisted by the magnet 24. When the contact 15 is moving back to the position shown, then by the time it has moved out of contact with the fixed contact, its momentum is such that it will move out of the influence of the magnet 24 sufficiently to cause the contact 15 to move back to the position indicated in the drawing.

I claim:

1. In combination with a double acting electromagnet, a load circuit controlled by the electromagnet, and a source of electrical energy having first and second terminals, the improvement comprising a control circuit for controlling the energization of the electromagnet from the source of electrical energy including first switch means operable at least between first and second positions, first and second energy storage means coupled to said first switch means at one terminal thereof and to the first terminal of the source of energy at the other terminal thereof, said first switch means being coupled to the second terminal of the source of energy, the electromagnet being connected to said one terminal of each said first and second energy storage means, said first energy storage means being connected to directly charge from the source of energy and said second energy storage means being connected to charge through the electromagnet when said first switch means is in said first position, and said second storage means being connected to charge directly from the source of energy and said first storage means being connected to charge through the electromagnet from the source of energy when said first switch means is in said second position, a second switch means connected between the source and the electromagnet and said storage means for controlling the current flow in the electromagnet, said first switch means reversing the current through the electromagnet upon successive actuations of said first switch means, holding means for retaining said first switch means in the last position thereof between actuations of said second switch means, and means forming an independent discharge path for each of said first and second storage means between actuations of said second switch means.

2. The improvement of claim 1 wherein said first and second storage means are capacitors.

3. The improvement of claim 2 wherein said first and second capacitors are connected in series with said first and second switch means.

4. The improvement of claim 2 wherein said discharge path forming means is a resistor connected across each capacitor.

5. The improvement of claim 4 wherein said electromagnet and said switch means controls current flowing in a load circuit connected across the source of energy by means of a third switch connected in controlling relation therewith.

6. The improvement of claim 5 wherein said holding means is a permanent magnet acting on said first switch means.

* * * * *